United States Patent [19]

Lambert

[11] Patent Number: 4,877,213

[45] Date of Patent: Oct. 31, 1989

[54] CONFERENCE EASEL

[75] Inventor: Joël Lambert, Virieu sur Bourbre, France

[73] Assignee: Solyfob Fonctions, Isere, France

[21] Appl. No.: 149,753

[22] Filed: Jan. 29, 1988

[30] Foreign Application Priority Data

Jan. 29, 1987 [FR] France ..... 87 01381

[51] Int. Cl.[4] ..... A47G 1/06

[52] U.S. Cl. ..... 248/451; 248/454; 40/156

[58] Field of Search ..... 248/441.1, 444.1, 450, 248/451, 452, 453, 454, 460; 282/29 B; 281/45; 40/156, 158 R

[56] References Cited

U.S. PATENT DOCUMENTS

| | | | |
|---|---|---|---|
| Re. 23,906 | 12/1954 | Griffin | 282/29 B |
| 3,195,849 | 7/1965 | Maddox | 248/441.1 |
| 3,310,901 | 3/1967 | Sarkisian | 40/156 |
| 3,363,871 | 1/1968 | Slazik | 248/451 |
| 3,623,691 | 11/1971 | Albee | 248/454 |
| 4,356,648 | 11/1982 | Beaulieu | 40/156 |
| 4,422,613 | 12/1983 | Cray | 248/441.1 |
| 4,457,717 | 7/1984 | Chika | 248/444.1 |
| 4,498,255 | 2/1985 | Heard | 40/156 |
| 4,523,400 | 6/1985 | Seely | 40/156 |
| 4,702,025 | 10/1987 | Mace | 40/156 |

FOREIGN PATENT DOCUMENTS

| | | | |
|---|---|---|---|
| 2342534 | 9/1977 | France | 40/156 |
| 69504 | 1/1944 | Norway | 248/460 |
| 292343 | 8/1953 | Switzerland | 40/156 |

*Primary Examiner*—J. Franklin Foss
*Assistant Examiner*—Robert A. Olson
*Attorney, Agent, or Firm*—Herbert Dubno

[57] ABSTRACT

A conference easel is provided with upper and lower frame sections and a pair of vertical frame sections pointed together by corner members in plug-and-socket connections. The profiled sections can be of tubular and can have projecting tubular portions forming channels accommodating edges of a panel. Two legs of tripod support are slidable in the vertical frame sections while a pair of flap profiles are articulated to the upper and lower frame sections to form, respectively, a clamp for a paper pad on the easel and a tray for writing compartments.

12 Claims, 3 Drawing Sheets

CONFERENCE EASEL

FIELD OF THE INVENTION

My present invention relates to a conference easel.

BACKGROUND OF THE INVENTION

A conference easel generally comprises a support for a pad of paper, mounted upon legs and which may be used for demonstration and illustration purposes at meetings or the like. Generally, a tray is provided at the bottom of the pad for pencils, crayons, chalk, markers or the like writing-implements, while a clamping device or like structure is provided at the top of the easel to retain the pad.

The legs supporting the easel can be slidable in vertical frame members forming the support and on which a panel can be mounted while a third leg can be swingable from the support to form a tripod with the other two legs.

The means for supporting the pad may include a row of pins at the top of the easel and are engageable in holes in the pad.

While such easels have had widespread application, they are nevertheless deficient in many esthetic respects, usually do not provide sufficient protection for the edges of the panel to prevent wear and deterioration, and usually require a wide variety of different parts and elements to support the legs and the panel, to hold the pad and to mount the tray.

OBJECTS OF THE INVENTION

It is, therefore, the principal object of the present invention to provide an improved conference easel in which these drawbacks are eliminated.

Another object of this invention is to provide an easel of relatively simple and economical construction which is more versatile than conventional easels and which provides better protection for the panel structure.

It is also an object of the invention to provide a presentation or conference easel which is more esthetic and cooperates with its paper pad more effectively than prior art devices.

SUMMARY OF THE INVENTION

These objects and others which will become apparent hereinafter are attained, in accordance with the invention in a conference easel formed from frame elements each of which is constituted by a profile having, as seen in transverse section:

a main part or portion which is tubular and which is extended laterally by a projecting portion, which may be referred to as a panel-receiving portion, formed on one of its faces oriented perpendicularly to the principle portion, with means for mounting a panel, and on its end face provided with means for pivotally mounting a flap or shutter capable of being deposited in two stable positions including a position in which the flap extends or reaches away from the projection or panel-receiving portion as an extension thereof and a position in which the flap is perpendicular to this panel-receiving portion.

In practice, four frame profile sections can be provided in mutually identical pairs, interconnected by angle members, all of the frame sections being identical in cross section and the upper and lower horizontal frame sections being provided with flaps pivotally connected thereto in the manner described. The two vertical frame sections serve to slidably receive respective legs and a lateral wall of each of the frame sections in the manner described is equipped with a recess or channel adapted to receive a respective edge of a panel whose thickness is provided in accordance with requirements of the easel to be fabricated.

As noted, the horizontal frame sections at the top and bottom of the panel are each equipped with a swingable flap. The flap articulated on the upper frame section can be swung downwardly to form a clamp for the upper edge of the paper pad and may define a tear edge against which the papers previously used may be torn from the pad. The flap swingable on the lower frame section may, upon being swung outwardly, form the writing-implement tray and, upon being swung inwardly, can hold in place the free edges of the sheets of the pad.

The vertical frame sections can, in addition, support a swingable third leg located centrally between these vertical frame sections.

The resulting easel has been found to have a particularly esthetic appearance because all of the edges and corners of the panel are fully encased in the peripherally closed frame formed by the four profiled frame sections and the corner members interconnecting them with plug-and-socket connections. As a consequence, the entire frame can be handled with a minimum of deterioration and wear over time. Since the two legs are slidable directly within the vertical frame sections, it is no longer necessary to form special elements for mounting and controlling these legs. Furthermore, the ability to use the same type of flap for both the clamp at the top of the pad and the writing-implement tray simplifies construction. The two flaps can be maintained in stable closed positions against the pad and in open positions, in the case of the writing-implement tray and for replacement of the pad.

The frame section profiles and the flaps can be fabricated from metal, e.g. extruded light metal such as aluminum, or from synthetic resin extrusions so that the entire easel will be light and easily carried.

Advantageously, the frame section profiles are constituted by a body in which the main tubular portion is of square cross section, extended laterally by a tubular part of rectangular cross section and which is formed with a flange which is likewise tubular and of rectangular cross section adjacent the end of the extension.

At this end of the extension, a semicylindrical recess is provided in which a generally cylindrical projection of a flap can be resiliently enlarged to form a pivot joint and the flanges can form a U-section channel accommodating a panel edge on the extension. A rib between the flange and the square-section main portion may be provided to define a narrower channel for a panel of appropriate thickness.

Thus the invention comprises a conference easel which comprises a tubular frame having a pair of opposite generally vertical frame sections, a pair of generally horizontal upper and lower frame sections, and corner members interconnecting the frame sections, all of the frame sections being formed as identical profile elements having a main tubular portion and, projecting perpendicular from the main tubular portion, a panel-receiving portion having an edge remote from the main tubular portion; legs supporting the tubular frame and operatively connected therewith; a panel enclosed by the frame and received in the panel-receiving portions of the sections; and at least one elongated flap pivotally connected to the edge of a respective one of the horizontal frame sections and swingable between two stable positions including a position wherein the flap forms generally an extension of the respective panel-receiving portion reaching away from the respective main tubular portion and a position wherein the flap lies generally perpendicular to the respective panel-receiving portion.

The easel can have a panel formed at an upper edge thereof with pins engageable in holes of a pad of paper to be mounted on the easel, and each of the horizontal sections can be provided with a respective one of the flaps, the flap of the upper horizontal section serving to hold the pad on the pins, the flap of the lower horizontal section forming a writing-implement tray.

Advantageously the main tubular portion is generally of a square cross section and the panel-receiving portion is generally tubular and of rectangular section, the panel-receiving portion having a first wall lying flush with and extending one of the walls of the respective main tubular portion in the position of the panel-receiving portion reaching away from the main portion, an end wall formed with a generally semicylindrical recess swingably receiving a generally cylindrical projection on the flap, and a further wall provided with a tubular flange of substantially rectangular cross section perpendicular to the first and further walls adjacent the end wall and delimiting with the respective main portion a generally U-section channel receiving an edge of the panel.

The other wall can be provided with a rib extending parallel to the tubular flange but spaced therefrom centrally between the main portion and the flange and of a height less than that of the flange to receive the panel between the rib and the tubular flange.

The generally cylindrical projection is received elastically in the respective generally cylindrical recess.

The flap can be formed at a location spaced from the generally cylindrical projection with a wing having an enlargement at a free end thereof, the flange having a recessed edge resiliently receiving and retaining the enlargement when the flap is in the position generally perpendicular to the respective panel-receiving portion.

The flap is formed at a location opposite the generally cylindrical projection with a beak-shaped edge projecting to the same side of the flap as the projection.

The upper frame section receives two tubular members adjacent one another in the respective main portion, of a length less than that of the upper section, and of cross sections slightly less than half the internal section of the main portion of the upper section, each of the tubular members traversing a respective one of the corner members and being extractable therethrough.

The tubular members have beveled ends within the upper section to prevent interference between the tubular members upon reinsertion of the tubular members into the upper section.

Each of the tubular members is provided with a spring-biased pin engageable in a hole formed in the upper section for releasably retaining the tubular member against extraction from the respective upper section.

BRIEF DESCRIPTION OF THE DRAWING

The above objects, features and advantages of our invention will become more readily apparent from the following description, reference being made to the accompanying highly diagrammatic drawing in which.

SPECIFIC DESCRIPTION

Figure 1:
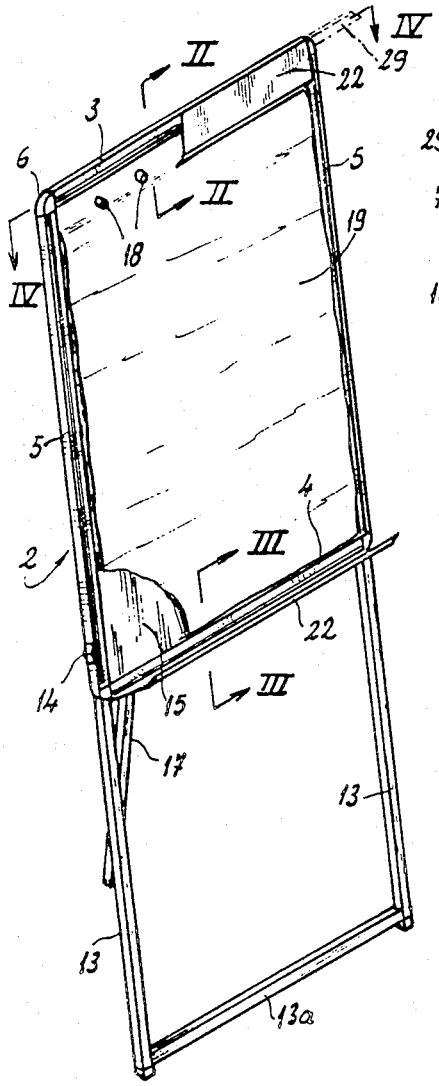
FIG. 1 is a perspective view, partly broken away, of a conference easel provided with a pad according to the invention.

The easel shown in FIG. 1 comprises a body generally represented at two and constituted by four frame sections, namely, the upper horizontal section 3, the lower horizontal section 4 and the 2 vertical sections 5, all cut from a continuous extrusion and having the same profile.

The frame sections, 3, 4, and 5 are assembled into a complete frame by four angle members 6 best seen in FIG. 5 and described in greater detail below.

Figure 2:
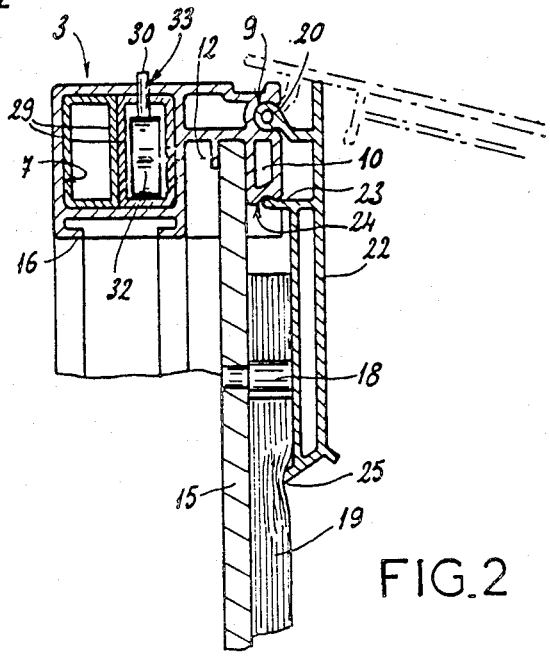
FIG. 2 is a cross sectional view taken along the line II—II of FIG. 1, but drawn to a larger scale.
Figure 3:
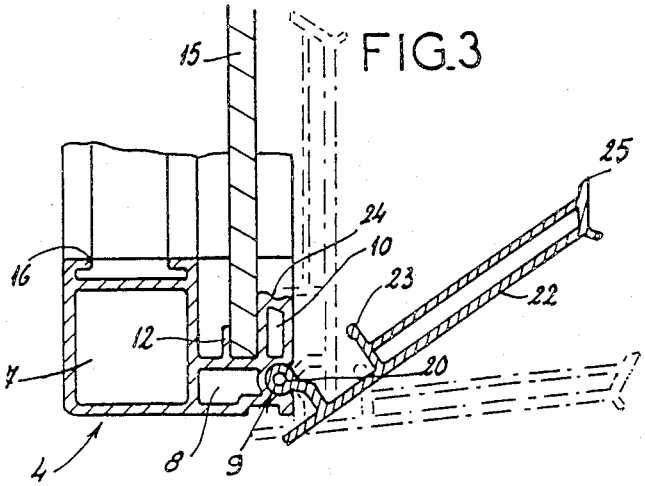
FIG. 3 is a section taken along the line III—III of FIG. 1 but drawn to the scale of FIG. 2.
Figure 4:
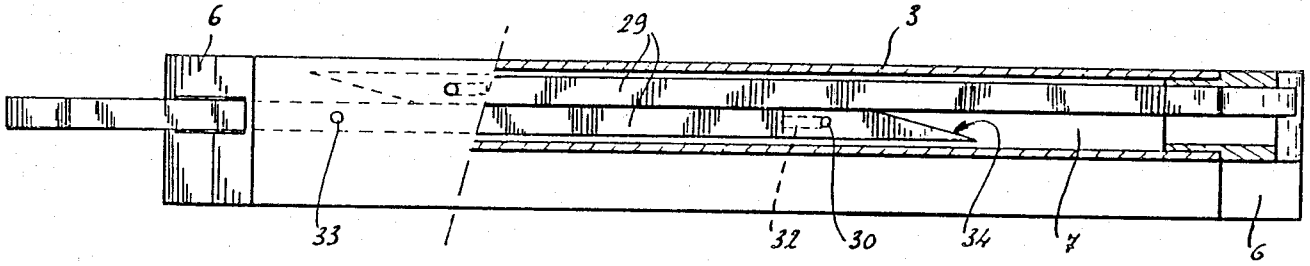
FIG. 4 is a partial section through the upper frame section of the easel, generally along the line IV—IV thereof.

As can best be seen from FIGS. 2 through 4, each of the frame section profiles comprises a main portion 7 which has a square transverse cross section. This principal portion is extended at one of its faces by a panel-receiving projecting portion 8 whose cross section is generally rectangular and one of the walls of which is an extension of one wall of the principle portion 7. The portion 8 has a thickness less than the thickness of the principal portion 7.

At its end face, the panel-receiving portion 8 is formed with a semicylindrical recess 9. The portion 8 is also formed with a tubular flange 10 of generally rectangular cross section which is spaced from another wall of the square section portion 7 and defines a U-section channel with the latter to accommodate a panel 15 of appropriate thickness.

Substantially midway between the flange 10 and the main portion 7, a rib 12 rises from the portion 8 to a height less than that of the flange so that a thinner panel, as shown, can be accommodated without play in the channel.

The principal portion 7 of the vertical frame sections serves directly to slidably receive two legs 13 of square cross section and likewise formed as profiled extrusions which can be connected together at their lower ends by a transverse **13*a* (FIG. 1). The legs are slidable within the sections 5 and can be locked at any degree of extension therefrom by a locking device 14** formed only diagrammatically in the drawing as a locking button, but representing any desired locking means for two telescoping frame sections. Such locking means can include a positive lock (pin and hole device), a friction lock, (weg device) or some other friction clamp arrangement.

When a thick panel is employed, of course, its edge will rest against the rib edge in the respective channel of the frame section.

If the easel is to be used as a showcase, without a paper pad and for the presentation of information, a sliding glass panel will be used and a back wall for the showcase can be inserted between the inwardly extending wings 16 formed on the main portion 7 and providing a formed channel.

Figure 6:
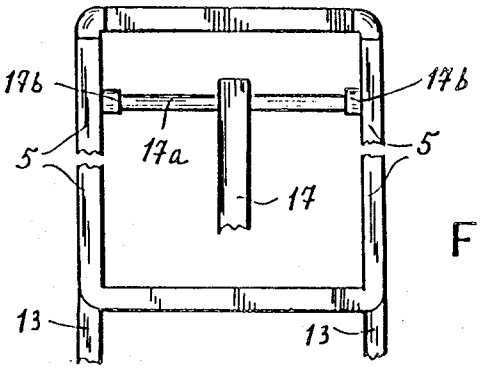
FIG. 6 is a fragmentary view of the rear of the easel body illustrating the third leg.

The rear leg 17 can, as seen from FIG. 6, be mounted on a horizontal shaft 17*a* engaged in bars 17*b* which can be fixed on the vertical frame sections 5.

In addition, the panel 15 is provided with a row of pins 18 (see FIGS. 1 and 2) projecting from the front face of the panel and engaging in holes of pad 19 of perforated paper sheets.

The recesses 9 of each of the upper and lower profiled sections 3 and 4 are adapted to elastically engage a cylindrical projection 20 jutting out from a wall 22 forming part of a flap which has a tubular portion of generally rectangular cross section spaced from the projection 20. The projection 20 has a generally cylindrical configuration and permits a swinging displacement of each flap 22 between two stable projections in which each flap finds itself respectively substantially perpendicular to and substantially parallel to the panel 15. To maintain the flap in a position perpendicular to the panel, the elastic engagement or jamming of the point may be used. When the two flaps are swung perpendicular to the panel, the remainder of an original pad may be removed and a new pad inserted on the pins. For the lower flap, the latter is in a position to act as a writing instrument tray.

The flaps can be maintained in positions parallel to the panel by the elastic engagement of an enlargement 23 on a wing perpendicular to the plane of each flap 22 spaced from the projection 20 in a recess 24 formed along an edge of the flange 10. This detent arrangement insures that the upper flap will be held against the pad (FIG. 2) so that a beak-shaped free edge 25 of this flap will form a tearing edge for the leaves of the pad. For the lower flap, this detent arrangement holds the flap against the pad as well to prevent the free lower edges of the leaves from swinging away from the pad during transportation and storage of the easel.

The beak-like formation 25 of the lower flap, of course, defines the outer wall of the tray when this flap is open to prevent the writing implement from falling from the tray.

Figure 5:
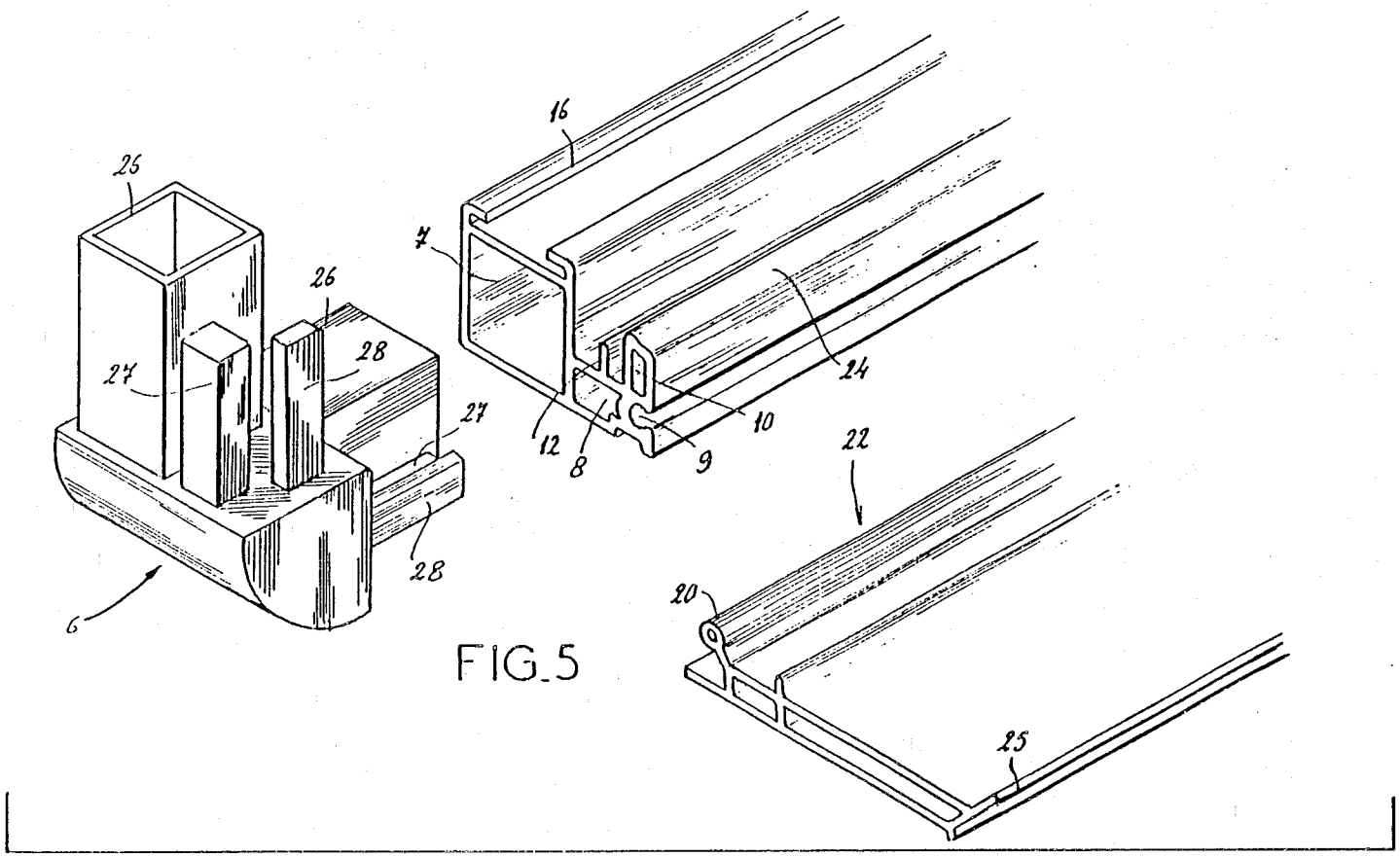
FIG. 5 is a perspective view in exploded form illustrating the relationship between a corner member and the frame section and flap 2 joined thereby.

As can be seen from FIG. 5, the four frame section profiles 3, 4 and 5 are assembled by plug-and-socket interconnection with angle members 6, each of which have two male portions 26 of square cross section engaging in the main tubular portion 7 of the two frame sections to be interconnected by each corner. In addition, each corner member has two male parts 27 and 28 of rectangular cross section respectively fitting snugly in the portions 8 and 10 of the frame sections. It is possible, for ease and manufacture, to fabricate each corner member 6 from two parts, one formed with the male members 26 and other with the male parts 27 and 28 and to join these two pieces together, e.g. by welding.

Advantageously, and as shown in FIGS. 1 and 4, the upper frame member 3 received two profiled bars 29 of lengths slightly smaller than that of the frame section 3 and rectangular cross sections which are each slightly less than half of the section of the principal portion 7 in which they are slidably received. These two bars can be withdrawn through respective angle members 6 via openings provided therein so that they can provide hangers on which sheets of paper from the pad previously utilized can be hung.

The means for retaining the bars each in their extracted and retracted positions can include a pin 30 on each bar biased outwardly by a spring 32 and engaging in orifice 33 of the frame section 3, one such orifice being provided for the retracted position and another orifice being provided for the extended position of each bar.

The inner end 34 of each bar 29 is beveled or tapered to prevent the bars from abutting one another when they are thrust back into the section 3.

The easel of the invention thus is simple but allows different types of panels to be used depending upon different uses of the easel, permitting, as noted, the easel to function not only for support of a pad, but also as a glass display window. The wear or damage of panel edges is precluded and a particularly esthetic appearance can be observed.

The invention, of course, is limited to the particular embodiment illustrated but can include all variations within the spirit and scope of the impended claims.

Modifications may be made, within the limits of the present claims of the cross section of the profiles and, for instance, it is possible to make the main portion of the profile of circular cross section.

We claim:

1. A conference easel, comprising:

a tubular frame comprising a pair of opposite generally vertical frame sections, a pair of generally horizontal upper and lower frame sections, and corner members interconnecting said frame sections, all of said frame sections being formed as identical profile elements having a main tubular portion and projecting perpendicular from said main tubular portion, a tubular panel-receiving portion having an edge remote from said main tubular portion; portion and panel-engaging means on a face of said panel-receiving portion extending parallel to said main tubular portion;

legs supporting said tubular frame and operatively connected therewith;

a panel enclosed by said frame and engaged in said panel-engaging means of said sections; and at least one elongated flap pivotally connected to the said edge of a respective one of said horizontal frame sections and swingable between two stable positions including a position wherein said flap forms generally an extension of the respective panel-receiving portion reaching away from the respective main tubular portion and a position wherein said flap lies generally perpendicular to the respective panel-receiving portion.

2. A conference easel, comprising:

a tubular frame comprising a pair of opposite generally vertical frame sections, a pair of generally horizontal upper and lower frame sections, and corner members interconnecting said frame sections, all of said frame sections being formed as identical profile elements having a main tubular portion and, projecting perpendicular from said main tubular portion, a panel-receiving portion having an edge remote from said main tubular portion and panel-engaging means on a face of said panel-receiving portion extending parallel to said main tubular portion;

legs supporting said tubular frame and operatively connected therewith;

a panel enclosed by said frame and engaged in said panel-engaging means of said sections; and at least one elongated flap pivotally connected to the said edge of a respective one of said horizontal frame sections and swingable between two stable positions including a position wherein said flap forms generally an extension of the respective panel-receiving portion reaching away from the respective main tubular portion and a position wherein said flap lies generally perpendicular to the respective panel-receiving portion, said main tubular portion being generally of a square cross section and said panel-receiving portion is generally tubular and of rectangular section, said panel-receiving portion having a first wall lying flush with one of the walls of the respective main tubular portion, an end wall formed with a generally semi-cylindrical recess swingably receiving a generally cylindrical projection on said flap, and said panel-engaging means comprising a further wall provided with a tubular flange of substantially rectangular cross section perpendicular to said first wall adjacent said end wall and delimiting with the respective main portion a generally U-section channel receiving an edge of the panel.

3. The easel defined in claim 2 wherein said panel is formed at an upper edge thereof with pins engageable in holes of a pad of paper to be mounted on said easel, and each of said horizontal sections is provided with a respective one of said flaps, the flap of said upper horizontal section serving to hold said pad on said pins, the flap of said lower horizontal section forming a writing-implement tray.

4. The easel defined in claim 2 wherein said panel-receiving portion is provided with a rib extending parallel to said tubular flange but spaced therefrom centrally between said main portion and said flange and of a height less than that of said flange to receive said panel between said rib and said tubular flange.

5. The easel defined in claim 4 wherein said generally cylindrical projection is received elastically in the respective generally cylindrical recess.

6. The easel defined in claim 4 wherein said flap is formed at a location spaced from said generally cylindrical projection with a wing having an enlargement at a free end thereof, said flange having a recessed edge resiliently receiving and retaining said enlargement when said flap is in said position generally perpendicular to the respective panel-receiving portion.

7. The easel defined in claim 6 wherein said flap is formed at a location opposite said generally cylindrical projection with a beak-shaped edge projecting to the same side of said flap as said projection.

8. The easel defined in claim 7 wherein said panel is formed at an upper edge thereof with pins engageable in holes of a pad of paper to be mounted on said easel, and each of said horizontal sections is provided with a respective one of said flaps, the flap of said upper horizontal section serving to hold said pad on said pins, the flap of said lower horizontal section forming a writing-implement tray.

9. A conference easel, comprising:

a tubular frame comprising a pair of opposite generally vertical frame sections, a pair of generally horizontal upper and lower frame sections, and corner members interconnecting said frame sections, all of said frame sections being formed as identical profile elements having a main tubular portion and, projecting perpendicular from said main tubular portion, a panel-receiving portion having an edge remote from said main tubular portion and panel-engaging means on a face of said panel-receiving portion extending parallel to said main tubular portion;

legs supporting said tubular frame and operatively connected therewith;

a panel enclosed by said frame and engaged in said panel-engaging means of said sections; and at least one elongated flap pivotally connected to the said edge of a respective one of said horizontal frame sections and swingable between two stable positions including a position wherein said flap forms generally an extension of the respective panel-receiving portion reaching away from the respective main tubular portion and a position wherein said flap lies generally perpendicular to the respective panel-receiving portion, said upper frame section receiving two tubular members adjacent one another in the respective main portion, of a length less than that of said upper section, and of cross sections slightly less than half the internal section of said main portion of said upper section, each of said tubular members traversing a respective one of said corner members and being extractable therethrough.

10. The easel defined in claim 9 wherein said tubular members have beveled ends within said upper section to prevent interference between said tubular members upon reinsertion of said tubular members into said upper section.

11. The easel defined in claim 10 wherein each of said tubular members is provided with a spring-biased pin engageable in a hole formed in said upper section for releasably retaining the tubular member against extraction from the respective upper section.

12. The easel defined in claim 9 wherein said panel is formed at an upper edge thereof with pins engageable in holes of a pad of paper to be mounted on said easel, and each of said horizontal sections is provided with a respective one of said flaps, the flap of said upper horizontal section serving to hold said pad on said pins, the flap of said lower horizontal section forming a writing-implement tray.

* * * * *